US008166874B2

(12) United States Patent
Schoch

(10) Patent No.: US 8,166,874 B2
(45) Date of Patent: May 1, 2012

(54) VIBRATION SEVERITY MONITOR TO CONTROL PRESS OPERATING SHUTHEIGHT AND PROCESS OPERATING CONDITIONS

(75) Inventor: Daniel A. Schoch, Minster, OH (US)

(73) Assignee: The Minster Machine Company, Minster, OH (US)

( * ) Notice: Subject to any disclaimer, the term of this patent is extended or adjusted under 35 U.S.C. 154(b) by 771 days.

(21) Appl. No.: 11/778,811

(22) Filed: Jul. 17, 2007

(65) Prior Publication Data

US 2011/0154999 A1 Jun. 30, 2011

(51) Int. Cl.
*B30B 13/00* (2006.01)
*B30B 15/14* (2006.01)

(52) U.S. Cl. ..... 100/35; 100/257; 72/21.1; 72/446

(58) Field of Classification Search ..... 100/35, 100/46, 257, 258 R, 258 A; 72/17.2, 21.1, 72/446; 700/206
See application file for complete search history.

(56) References Cited

U.S. PATENT DOCUMENTS 4,918,956 A * 4/1990 Schoch ..... 72/21.1
4,945,742 A * 8/1990 Schoch ..... 72/17.2
5,285,722 A * 2/1994 Schockman ..... 100/347
6,209,400 B1 4/2001 Schoch et al.
6,267,050 B1 7/2001 Brewer
6,466,840 B1 10/2002 Schoch
6,484,106 B1 11/2002 Schoch
6,594,597 B1 7/2003 Schoch
6,668,609 B2 12/2003 Schoch
6,715,409 B2 4/2004 Brewer et al.
6,772,682 B1 * 8/2004 Daniel et al. ..... 100/347
6,820,026 B1 11/2004 Schoch
2003/0018409 A1 * 1/2003 Schoch ..... 700/206
2004/0159140 A1 * 8/2004 Daniel et al. ..... 72/455

* cited by examiner

*Primary Examiner* — Jimmy T Nguyen
(74) *Attorney, Agent, or Firm* — Taylor IP, P.C.

(57) ABSTRACT

A system monitors vibration activity in a press machine environment and generates a signal indicative of vibration level severity. An accelerometer can provide measured peak acceleration data that serves as an indication of vibration level. The vibration measurement, is compared to a reference vibration level that corresponds to a run condition of desired operating parameters. A controller controls the press machine shutheight in accordance with the differential expressed in the comparison result. The consequent shutheight adjustment effects a change in the vibration activity that acts as a correction to the deviation in vibration behavior expressed by the differential.

11 Claims, 2 Drawing Sheets

VIBRATION SEVERITY MONITOR TO CONTROL PRESS OPERATING SHUTHEIGHT AND PROCESS OPERATING CONDITIONS

BACKGROUND OF THE INVENTION

1. Field of the Invention

The present invention relates to press machines, and, more specifically, to a method and system for controlling the shutheight using vibration severity monitor data.

2. Description of the Related Art

Production field testing has shown that once the process conditions have been established in a material forming machine, the material forming process itself remains substantially consistent as long as the operating parameters are, not changed.

However, parameter changes can occur in a variety of ways that impede machine performance and proper workpiece production. For example, parameter changes can be created by persons involved with the process in several ways, including arbitrary tooling set-up and shimming changes, arbitrary close-in changes in operating shutheight to "assure" part formation, changes of relative tool station heights during periodic grinding of the tooling, and gradual substitution of stock materials from that specified.

There are also inherent changes to the process operating shutheight that are created by the thermal and speed change effects of the press and die. Further, there are changes to the severity of the vibration level.

What is needed in the art is a strategy that compensates for changes in the operating parameters in order to maintain consistent performance. What is needed, in particular, is a strategy for restoring the stabilized vibration severity conditions which correlates with the proper tooling set-up parameters, in a press machine environment to acceptable levels, thereby eliminating excessive vibration activity.

SUMMARY OF THE INVENTION

The present invention relates to a method and system for dynamically adjusting the press shutheight during a machining operation in accordance with vibration severity information, particularly changes in the vibration severity signature relative to a benchmark or reference level correlated to the proper tooling set conditions. The system implements an adjustment-in-motion (AIM) feature that provides on-the-fly adjustments to the press shutheight to maintain a desired performance level as indicated by the vibration severity behavior.

A vibration severity monitor is used to collect data indicative of vibration severity conditions present in the operating area and the die workspace. In one form, the monitor may use a sensor assembly employing accelerometers to provide measurements of the vibration signature. In alternate forms, the vibration severity level may include a peak acceleration level, vibration signature, force severity, or force signature.

One object of the invention is to maintain consistent press performance once the correct operating conditions are reached. For example, these conditions would include an operating profile that encompasses a specific die and material combination, a particular running speed, and a specific vibration severity level. This desired vibration level is considered a benchmark, set point, or zero reference level.

It is a further object of the invention to eliminate or minimize any deviation or departure of the actual measured vibration levels from the reference level.

The invention recognizes that changes in the vibration severity level are indicative of a departure from the correct operating conditions and can be corrected or compensated with appropriate changes to the shutheight.

To determine the amount of compensation or correction needed in the press shutheight, the recorded vibration level measurements are compared to the reference vibration value to generate a differential value. A control unit adjusts the press shutheight in accordance with the differential vibration level value. A feedback control mechanism may be used to govern the process of making the changes to the press shutheight based upon the results of the comparison between the monitored vibration severity levels and the benchmark value.

One advantage of the present invention is that the shutheight adjustment procedure affords the machining application with the ability to maintain a consistent and stable level of performance throughout the duty cycle of the job.

Another advantage of the invention is that control of the shutheight according to the monitored vibration severity data takes place during the machining operation and hence does not necessitate any interruption in the machining cycle, thereby providing an adjustment-in-motion, on-the-fly adjustment procedure.

Another, advantage of the invention is that the deleterious effects from changes in the operating parameters are remedied not by making corrections to the deviating parameters, but by counteracting the main effect attending such parameter changes—excessive vibration; notably, the invention introduces a change in the vibration activity (via change in shutheight) that offsets, reverses, or otherwise corrects the unwanted change in vibration activity that accompanies the change in operating parameters.

Another advantage of the invention is that the shutheight adjustment procedure provides a universal solution to excessive and unwanted vibration.

Another advantage of the present invention is that a key indicia of performance can be measured and used to make corrections to the vibration activity, without undue retrofitting of the machine environment, since the vibration behavior can be adjusted using any existing as-installed mechanism for shutheight adjustment.

Another advantage of the invention is that the vibration activity present in the machine can be made to conform to a standard or normalized level by facilitating changes to the vibration behavior with corresponding changes in the shutheight in a continual feedback scheme that fosters stable performance.

Another advantage of the invention is that it recognizes that changes in the vibration behavior can be induced by commensurate or proportional changes in the shutheight.

Yet a further advantage of the present invention is that the compensation scheme for varying the vibration activity—by making corrections to the shutheight—is effective regardless of the cause or reason why the vibration behavior changed in the first place.

Yet an even further advantage of the present invention is that by using the monitored vibration behavior as the basis for adjusting the shutheight, the invention addresses and corrects one of the chief sources of manufacturing errors, namely, excessive vibration.

BRIEF DESCRIPTION OF THE DRAWINGS

The above-mentioned and other features and advantages of this invention, and the manner of attaining them, will become more apparent and the invention will be better understood by reference to the following description of at least one embodiment of the invention taken in conjunction with the accompanying drawings, wherein.

Figure 1:
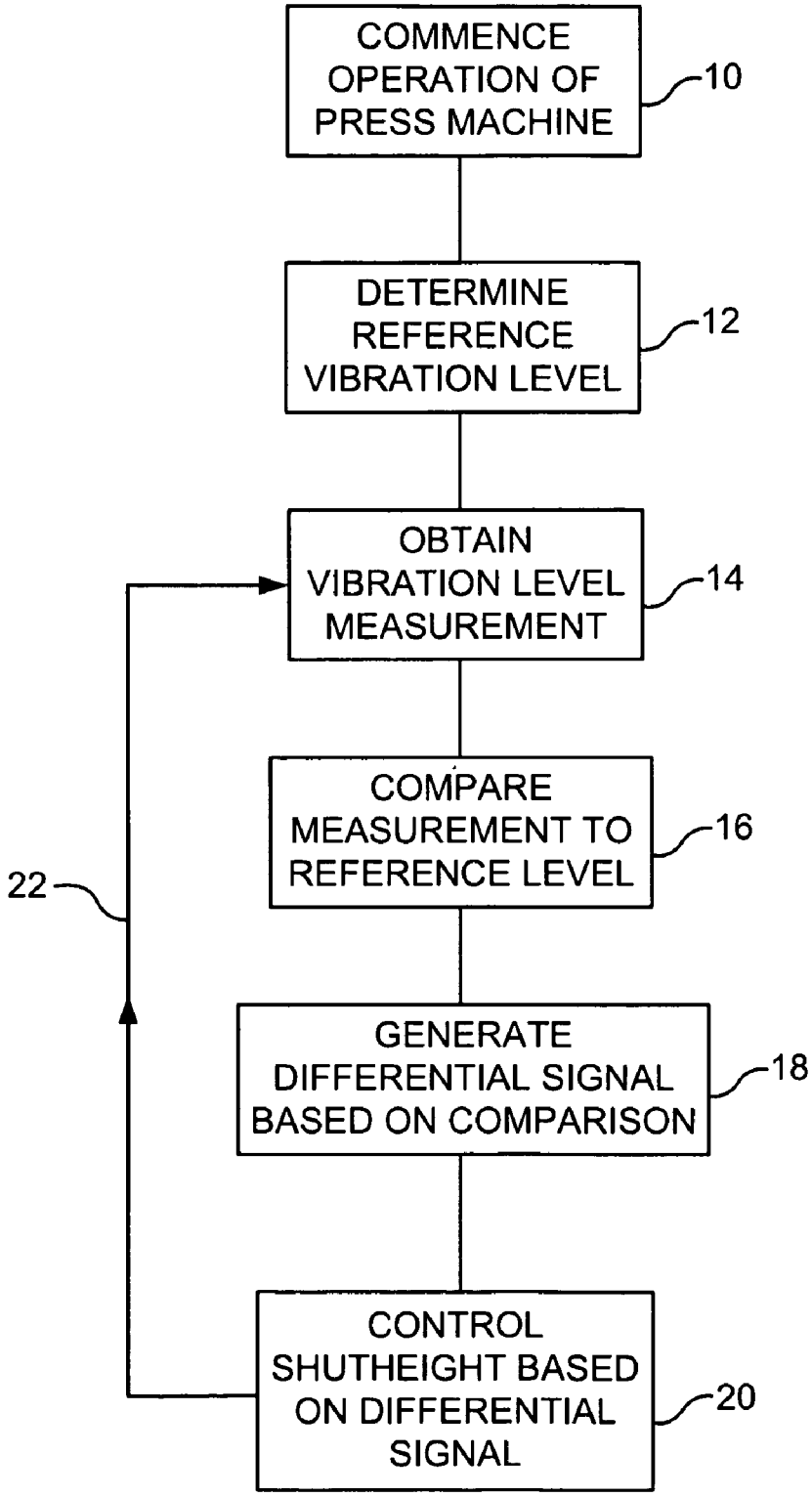
FIG. 1 is a flowchart illustrating a method for making adjustments to the press machine shutheight, according to one form of the invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring to FIG. 1, there is shown a flow diagram depicting a sequence of operations for establishing an adjustment-in-motion (AIM) control feature that conducts on-the-fly adjustments to the press shutheight based on an analysis of real-time vibration severity data, according to one form of the invention.

By way of overview, the invention recognizes that changes in the vibration characteristics of the press machine environment, such as vibration severity level, are indicative of a corresponding change in the press operating conditions. These operating conditions, for example, include a specific die and material combination, a particular press running speed and duration, and a certain machine operation. The operating conditions may include other operational parameters characteristic of the material forming operation, as known to those skilled in the art.

Together, these operating conditions constitute an operating profile that produce a characteristic and identifiable vibration behavior within the press machine. This vibration behavior serves as one of several types of vibration signatures (e.g. spectral, detailed acceleration signature, RMS velocity) for the corresponding operating conditions. The integrity and consistency of the press operating conditions can therefore be verified by monitoring the press vibration behavior. Thus, changes to the operating conditions are reflected by corresponding changes to the vibration behavior.

In one aspect of the invention, the vibration behavior that is correlated with the desired operating conditions serves as a baseline, benchmark, set point, or (zero) reference level. During a run of the press machine, the actual real-time vibration behavior can be monitored to provide measurement data indicative of the vibration level, such as a vibration severity level measurement which correlates to high quality part production. The measured vibration level is compared to the reference vibration level. In one form, this comparison yields a differential value reflecting the difference between the two levels.

The invention further recognizes that this differential value reflects a commensurate change in the operating profile, namely, one or more of the operating parameters or conditions. In another aspect of the invention, a controllable shutheight adjustment mechanism is provided within the press machine environment. The mechanism is configured to make selectively controlled adjustments to the shutheight in response to and in accordance with a control input.

The invention further recognizes that changes in the shutheight dimension produce corresponding changes in the vibration activity present in the press machine. Accordingly, any changes in the vibration behavior from that specified by the desired operating conditions can be corrected or compensated for by making appropriate changes to the shutheight.

To implement this compensation/correction feature, the differential value between the measured vibration level and the reference vibration level is used to formulate a suitable control signal for the shutheight adjustment mechanism. The mechanism then conducts a shutheight adjustment operation in accordance with the control signal. This control signal facilitates and/or effectuates a change in the shutheight commensurate with the differential value, in a manner sufficient to return and/or restore the vibration activity to the reference vibration behavior.

Any suitable type of data indicative of vibration activity may be used to practice the invention. For example, the vibration activity may be specified by a peak acceleration level, a vibration signature, force severity, force signature, and/or a vibration severity level. The vibration activity can be expressed as a single reading (measurement) or as a composite reading that incorporates multiple measurements (such as from multiple vibration sensors of different types).

Referring more specifically to FIG. 1, the shutheight control procedure is initiated following commencement of the press machine operation (step 10). The press machine operation and proper tool set-up is commenced in a conventional manner to produce high quality part production known to those skilled in the art. For example, there is an appropriate set-up for the die members and workpiece. Further, the press is programmed with the desired running speed.

A reference vibration level or value is provided to establish a baseline or benchmark value for vibration behavior in the press machine (step 12). The reference vibration level may be determined in a variety of ways. For example, it may be supplied as a predetermined value prior to the current machining session, in which case it could be derived from a theoretical calculation (e.g., material forming simulation) or from other press machine runs (e.g., runs that have the same or similar operating conditions to the current run).

More preferably, the reference vibration level is a real-time determination made during the course of the current press machine run, specifically once the correct operating conditions for the specific tooling are reached. As noted above, the press machine run is characterized by a set of operating conditions that specify an operational profile for the machining operation at hand. Once these operating conditions are reached (e.g., the press reaches its running speed), the characteristic signature of the press performance specified by the operating parameters is captured and represented by a selectable performance indicia, i.e., vibration level.

This vibration level specifies the consistent and stable performance measure that is desired for the duration of the press run. It should be apparent that the determination of the reference vibration level, if made during the course of the current press run, can be made at any time after commencement of the press run that is suited to identifying the stable long-term value of the vibration level corresponding to the programmed (and desired) operating conditions.

Any type of device suited to provide vibration data may be used by the invention. For example, the vibration data may be specified by outputs from accelerometers that can be placed at various locations in the press environment, e.g., the slide or die. The vibration level would then be indicated by a peak acceleration level. Other detection devices may include vibration signature sensors, force severity sensors, and/or force signature sensors. Vibration-type sensors can likewise be located at any site in the press environment, e.g., bed, slide, crown, die. As used herein, it should be understood that references to "level" or "value" or "measurement" can include one or more data elements. For example, in one form, it may be desired to generate vibration activity indicators using individual peak acceleration readings. Alternately, if multiple sensors are used, the vibration activity may be represented by a composite of readings taken from a collection of sensors.

Referring again to FIG. 1, the control procedure proceeds with the acquisition of vibration level measurements that are obtained during the course of the press run (step 14). This vibration level measurement is then compared to the reference vibration level specified in step 12 (step 16). A difference signal is generated based on the comparison operation that expresses the differential between the measured vibration level and the reference vibration level (step 18). Steps 16 and 18, for example, may in practice be consolidated into a single operation, such as by use of a differential comparator having the measured vibration level and reference vibration level as inputs.

The shutheight is controlled using the difference signal generated by step 18 (step 20). For this purpose, the difference signal is formulated or otherwise processed into an appropriate control signal for use as a control input to the shutheight adjustment mechanism, according to means known to those skilled in the art. In effect, the shutheight is controlled according to the difference between the measured vibration level and the reference vibration level.

The shutheight control operation aims to adjust the shutheight in a manner sufficient to restore the vibration activity level within the press machine to a desired or original state, namely, to that specified by the reference vibration level. This procedure reflects the notion that changes to the shutheight influence the vibration activity in the machine environment. The shutheight is adjusted according to the difference signal so as to eliminate the difference between the measured vibration level and reference vibration level.

In a preferred form of the invention, the compensation scheme for making corrections to the vibration activity is executed using a closed-loop feedback system that is configured to null out or eliminate the difference between the measured vibration level and the reference vibration level. For example, in reference to FIG. 1, the sequence of steps 14-16-18-20 would be regarded as a single iteration of the correction protocol that would be repeated continually in the manner of a feedback scheme (line 22) to close-out the difference between the measured vibration level and the reference vibration level and thereby facilitate maintaining of the measured vibration level—which reflects the actual real-time vibration activity in the press machine—at the desired reference vibration level.

In one variation to the procedure outlined in FIG. 1, it might be feasible to allow a certain deviation of the measured vibration level from the reference vibration level. For this purpose, an allowable margin of variation or tolerance range would be defined that constitutes an acceptability criteria. In this case, the difference signal generated by step 18 would be evaluated in relation to the tolerance range. If the difference signal is out of bounds (i.e., exceeds the acceptable tolerance), then the difference signal is directed to the shutheight controller to initiate a shutheight adjustment as above. Otherwise, if the difference signal is within bounds, then no shutheight change is initiated and the procedure proceeds to a next iteration of the control sequence at step 14.

Figure 2:
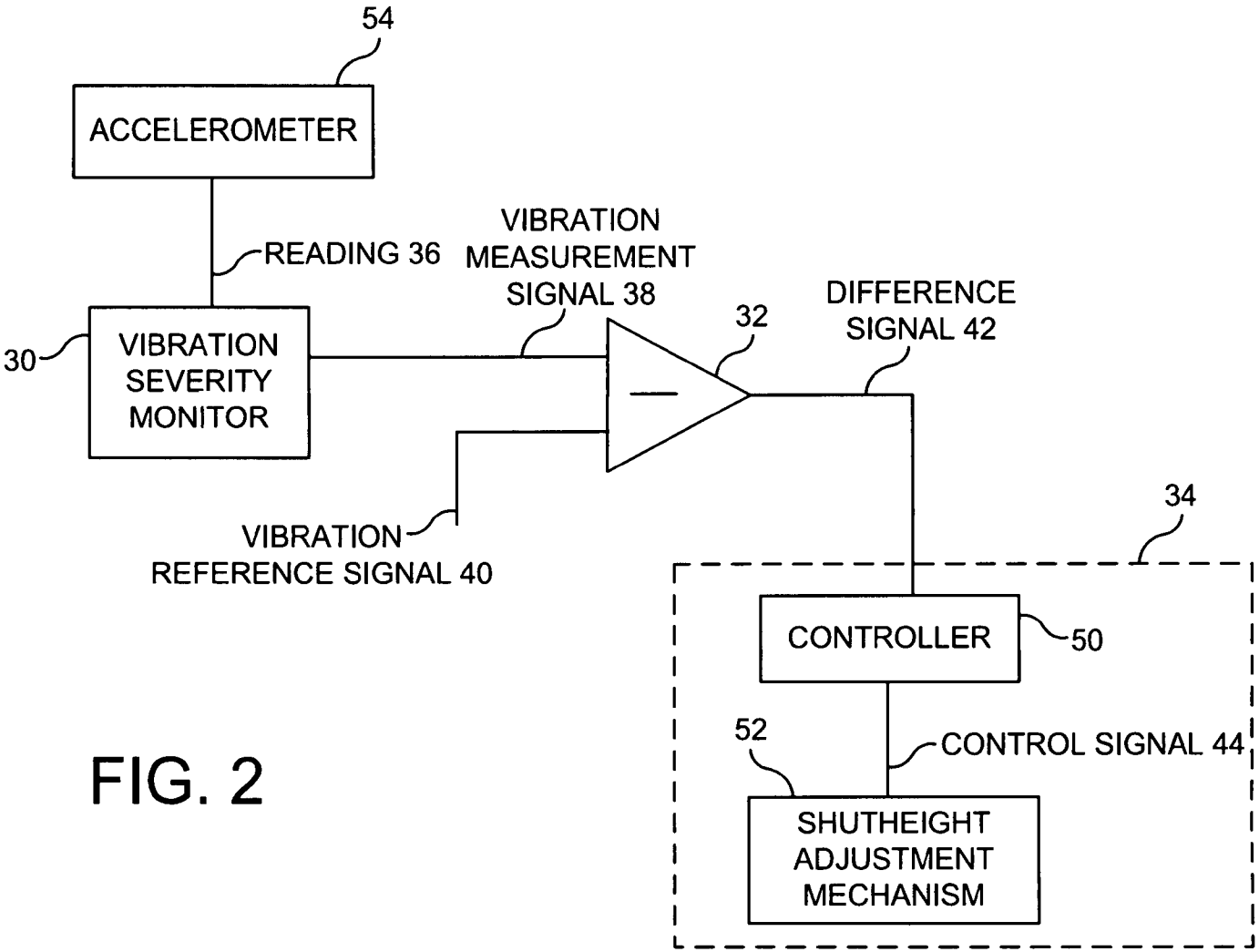
FIG. 2 is a block diagram illustration of one illustrative embodiment of the method shown in FIG. 1, according to another form of the invention.

Referring now to FIG. 2, there is shown a block diagram illustration of a system that implements the control procedure of FIG. 1, according to another form of the invention.

The system includes a vibration severity monitor 30, a differential comparator 32, and a shutheight adjustment system 34. These units are associated with a press machine.

The illustrated vibration severity monitor 30 monitors the vibration activity of the press machine during a running operation, namely, during a load condition of the machine directed to processing of a workpiece. Monitor 30 collects vibration data from individual vibration sensors or vibration indicators located in the machine environment.

In one form, monitor 30 is equipped or otherwise associated with one or more accelerometers 54 configured to provide acceleration data. The accelerometer may be located at any site in the press machine environment where vibration activity occurs. For example, suitable locations would include the slide and/or tooling member attached to the slide. The reading 36 furnished as an output from accelerometer 54 represents continuous acceleration data, for example.

The acceleration readings 36 are useful to the invention as an indicia of vibration behavior. In particular, monitor 30 receives the readings 36 and uses the peak acceleration level as a quantitative indicia of vibration levels. Data on vibration behavior may be provided by other devices, such as vibration sensors attached to non-movable parts (e.g., bed/bolster, press frame, tooling die mounted on the bed).

Monitor 30 then supplies this peak acceleration level as a vibration measurement signal 38 to a differential comparator 32. A vibration reference signal 40 is also provided as an input to comparator 32. Signal 40 serves as the benchmark value against, which the vibration measurement signal 38 is compared. For this purpose, signal 40 represents the same kind of data signified by vibration measurement signal 38. For example, in this illustrative embodiment, reference signal 40 will represent the peak acceleration value for the press machine application when operating at the desired operating conditions. Signal 40 may be furnished in any way, such as from accelerometer 54 during the initial phase of the machining application as the press is brought up to full operating speed.

Comparator 32 generates a difference signal 42 that represents the differential value between vibration measurement signal 38 and vibration reference signal 40. The difference signal 42 signifies the deviation or departure of the actual vibration level (indicated by measurement signal 38) from the reference vibration level (indicated by reference signal 40). This deviation, then, also signifies the extent to which the operating conditions—which bear directly upon vibration behavior—have departed from the initial desired operating conditions.

More particularly, the difference signal 42 signifies the extent to which the vibration behavior must be corrected in order to bring it back into alignment with the reference vibration activity corresponding to reference signal 40. For this purpose, difference signal 42 indicates the proportional change needed in the shutheight dimension in order to cause a corresponding change in the vibration behavior that is commensurate with the unwanted variation embodied in difference signal 42.

The difference signal 42 is furnished to shutheight adjustment system 34, which facilitates an adjustment in the shutheight using difference signal 42. Specifically, the shutheight is adjusted based upon and in accordance with the variation in vibration activity represented by difference signal 42. System 34 includes a controller 50 and a controllable shutheight adjustment mechanism 52. Mechanism 52 is configured to adjust the shutheight of the press machine according to a control input, namely, control signal 44 received from controller 50.

Controller 50 receives difference signal 42 and fashions a control signal 44 based on difference signal 42 in a manner known to those skilled in the art. Control signal 44 is formulated in a manner calculated to effectuate or otherwise facilitate a controlled change in the shutheight (via mechanism 52) that produces a change in the vibration activity that is proportional or otherwise commensurate with the variation in vibration activity indicated by difference signal 42.

The overall effect of the change in shutheight is to foster a correction or compensation in the vibration activity, so that the resultant vibration activity due to the change in shutheight is the same as the original vibration activity represented by reference signal 40.

Any conventional data processing means known to those skilled in the art can be used to generate the various signals shown in FIG. 2.

A preferred feature of the system depicted in FIG. 2 is that the shutheight adjustment is made on a continual basis according to the variations/deviations in vibration activity represented by difference signal 42, which itself is continually generated anew based on ongoing monitoring of the real-time vibration activity signified by a continual supply of current accelerometer readings 36. The purpose of such an ongoing correction of the vibration behavior—as implemented by changes in the shutheight)—is to maintain as consistent a performance as possible, i.e., to keep the vibration level at a certain level.

In order to optimize this strategy or approach to vibration correction, it is preferred that the system depicted in FIG. 2 be operated according to a feedback scheme, in a conventional manner known to those skilled in the art. For example, the indicated operations performed by the system—collection of vibration data (accelerometer readings), calculation of a differential signal between the vibration reference signal and vibration measurement signal, formulation of a control signal to control the shutheight change based on the differential signal, and execution of the shutheight change—together constitute a processing iteration that is continually repeated in the manner of a feedback loop in order to null or zero-out the difference signal 42. This null state indicates that there is no (or appreciably no) variation between the reference signal 40 and measurement signal 38, thereby indicating an acceptable level of vibration activity.

Although the preferred datum for assessing the integrity of the operational performance of the machining activity utilizes vibration readings, it should be understood that the invention may be practiced with other indicia of performance.

The invention may be practiced with any type of controllable shutheight adjustment system and any type of vibration monitoring device. Illustrative shutheight adjustment mechanisms and vibration monitors may be found in U.S. Pat. Nos. 6,209,400; 6,267,050; 6,466,840; 6,484,106; 6,594,597; 6,668,609; 6,715,409; 6,772,682; and 6,820,026, assigned to the same assignee as the present application and incorporated herein by reference thereto.

The present invention may be used in conjunction with any type of press machine environment. In one illustrative form, the invention may be used with mechanical presses, such as presses of the type that perform stamping and drawing operations. These presses employ a conventional construction which includes a frame structure having a crown and a bed. The press supports a slide in a manner enabling reciprocating movement of the slide towards and away from the bed. These press machines are widely used for a variety of workpiece operations employing a large selection of die sets, with the press machine varying considerably in size and available tonnage depending upon its intended use.

In one particular form of a mechanical press, the press includes a bed with a bolster. Attached vertically to the bed are uprights that support the crown. Above the crown and attached thereto is a press motor. A slide is suitably configured so that during machine operation, the press motor causes the slide to reciprocate in rectilinear fashion towards and away from the bed. A tooling assembly or die member is operatively connected to the slide. The reciprocating motion of the slide brings the die into repeated machining contact with a workpiece mounted on the bed. Leg members are formed as an extension of the bed and are generally mounted to the shop floor by means of shock absorbing pads.

The above description of the mechanical press should not be considered in limitation of the invention, but only for purposes of illustration, as the invention may be practiced with other types of machine environments.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for use in association with a press machine to adjust the press machine shutheight, said method comprising the steps of:

providing a reference signal;

running the press machine in an operation;

providing a performance indicia signal indicative of a performance aspect of the press machine operation;

comparing the performance indicia signal to the reference signal and generating a comparison signal representative thereof; and controlling the press shutheight using the comparison signal, the reference signal is indicative of a desired vibration severity level; and the performance indicia signal is indicative of a vibration severity level measurement taken from the running press machine.

2. The method as recited in claim 1, wherein:

the vibration severity level measurement includes at least one of peak acceleration level data, vibration signature data, force severity data, and force signature data.

3. The method as recited in claim 1, wherein the controlling step being performed while the machine is running.

4. A method for use in association with a press machine to adjust the press machine shutheight, said method comprising the steps of:

providing a reference signal representative of a desired vibration severity level;

running the press machine in an operation;

providing a performance indicia signal indicative of a performance aspect of the press machine operation;

comparing the performance indicia signal to the reference signal and generating a comparison signal representative thereof; and evaluating the comparison signal.

5. The method as recited in claim 4, wherein the evaluating step further includes the step of:

adjusting the press shutheight using the comparison signal if the comparison signal fails to satisfy an acceptability criteria.

6. The method as recited in claim 4, wherein the comparison signal indicates a differential between the performance indicia signal and the reference signal.

7. The method as recited in claim 4, wherein:

the performance indicia signal is indicative of a vibration severity level measurement taken from the running press machine.

8. A method for use in association with a press machine to adjust the press machine shutheight, the press machine including a shutheight adjustment system having a control input, the shutheight adjustment system being configured to control the press machine shutheight in accordance with input received at the control input thereof, said method comprising the steps of:

(i) providing a reference signal representative of a desired vibration severity level;

(ii) running the press machine in an operation;

(iii) providing a performance indicia signal indicative of a performance aspect of the press machine operation;

(iv) comparing the performance indicia signal to the reference signal and generating a comparison signal representative thereof;

(v) generating a control signal representative of the comparison signal;

(vi) providing the control signal to the shutheight adjustment system at the control input thereof; and (vii) iteratively repeating steps (iii)-(vi).

9. The method as recited in claim 8, wherein:

the performance indicia signal is indicative of a vibration severity level measurement taken from the running press machine.

10. A method for use in association with a press machine to adjust the press machine shutheight, comprising the steps of:

providing a reference signal representative of a desired vibration severity level;

providing a vibration signal indicative of vibration activity in the press machine;

comparing the vibration signal to the reference signal; and controlling the press shutheight using the comparison result.

11. The method as recited in claim 10, further includes the step of:

iteratively repeating the providing a vibration signal step, the comparing step, and the controlling step.

* * * * *